US008062042B2

(12) United States Patent
Patterson et al.

(10) Patent No.: US 8,062,042 B2
(45) Date of Patent: Nov. 22, 2011

(54) INTERNAL BUS BAR AND AN ELECTRICAL INTERCONNECTION MEANS THEREFOR

(75) Inventors: Brian T. Patterson, Lewisberry, PA (US); William J. Garver, Harrisburg, PA (US); Charles E. Reynolds, Mechanicsburg, PA (US); Rich Flickenger, Chester Springs, PA (US); Jae A. Eisenhower, West Chester, PA (US); Jere W. Myers, Washington Boro, PA (US); Todd M. Bergman, Lititz, PA (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 12/653,809

(22) Filed: Dec. 21, 2009

(65) Prior Publication Data

US 2010/0240234 A1 Sep. 23, 2010

Related U.S. Application Data

(60) Provisional application No. 61/139,252, filed on Dec. 19, 2008.

(51) Int. Cl.
*H01R 25/00* (2006.01)

(52) U.S. Cl. ..... 439/120

(58) Field of Classification Search ..... 439/120–122
See application file for complete search history.

(56) References Cited

U.S. PATENT DOCUMENTS

| | | | | |
|---|---|---|---|---|
| 7,351,075 | B1 * | 4/2008 | Patterson et al. | 439/121 |
| 7,661,229 | B2 * | 2/2010 | Frecska et al. | 52/220.6 |
| 2006/0272256 | A1 | 12/2006 | Frecska et al. | |
| 2007/0103824 | A1 | 5/2007 | Patterson et al. | |
| 2008/0060306 | A1 | 3/2008 | Platt et al. | |
| 2008/0087464 | A1 | 4/2008 | Patterson et al. | |
| 2008/0090431 | A1 | 4/2008 | Patterson et al. | |
| 2008/0090432 | A1 | 4/2008 | Patterson et al. | |

* cited by examiner

*Primary Examiner* — Truc Nguyen

(57) ABSTRACT

An electrified framework system for bringing power and/or signal to electrically powered devices is provided. The system includes at least one longitudinally extending electrified bus bar. The bus bar has a housing which includes a pair of conductors positioned therein. Each conductor has a mating surface which provides a continuous conductive path for attachment of devices. The system also includes a means to bring electricity to the conductors without interfering with the mating surface of the conductors and thereby creating an unavailable point for electrical connection.

4 Claims, 7 Drawing Sheets

INTERNAL BUS BAR AND AN ELECTRICAL INTERCONNECTION MEANS THEREFOR

CROSS REFERENCE TO RELATED APPLICATION

This application claims the benefit under 35 U.S.C. §119 (e) of U.S. Provisional Application Ser. No. 61/139,252, filed Dec. 19, 2008, entitled "Electrically Active Grid Framework Accessories".

BACKGROUND OF THE INVENTION

The present invention is directed to an electrically active framework and, more particularly, to an electrified bus bar and an electrical interconnection means which brings power and/or signal to conductive material housed internally in the bus bar.

Today's interior building environment is dominated by fixed lighting and a wide variety of electrical devices that are typically wired for a building's lifetime rather than occupants' changing needs. Building designers and owners increasingly have been seeking systems to make buildings more adaptable and to integrate infrastructure, equipment and furnishings that can improve a building's energy efficiency. Generally speaking, the increasing use of safe, low-voltage direct-current (DC) power and/or signal in interior control and peripheral devices, such as lighting, is a shift aimed at increasing adaptability and energy efficiency.

More specifically, U.S. Patent Application Publication Nos. 2006/0272256, 2007/0103824 and 2008/0087464 are examples of recent attempts to provide unprecedented design and space flexibility along with reduced energy usage via an enabling infrastructure which uses and distributes low-voltage DC power and/or signal. In short, these systems change the manner in which low-voltage direct-current (DC) power and/or signal is distributed to interior controls and devices resulting in an increase in flexibility, efficiency and sustainability of the interior building environment. In these systems, low-voltage DC power and/or signal is distributed and accessible via the conductors disposed on the support grid members of a grid framework. A low-voltage power and/or signal source is then attached to the infrastructure, i.e. the support grid members, via one or more connectors, which, in turn, electrifies the conductors and creates an electrified bus bar.

What is needed is a means to bring electricity to the conductors without creating keep-out zones. A keep out zone is a term used herein to define any point along the continuous conductive path that is unavailable for electrical connection due to interference or other obstruction of the mating surface of the conductors. How to bring power and/or signal to an internal bus bar without creating a keep-out zone has heretofore been unknown.

SUMMARY OF THE INVENTION

An electrified framework system for bringing power and/or signal to electrically powered devices is provided. The system includes at least one longitudinally extending electrified bus bar. The bus bar has a housing which includes a pair of conductors positioned therein. Each conductor has a mating surface which provides a continuous conductive path for attachment of devices. The system also includes a means to bring electricity to the conductors without interfering with the mating surface of the conductors and thereby creating an unavailable point for electrical connection

BRIEF DESCRIPTION OF THE DRAWINGS

The same reference numbers will be used throughout the drawings to refer to the same or like parts.

DETAILED DESCRIPTION OF THE INVENTION

Figure 1:
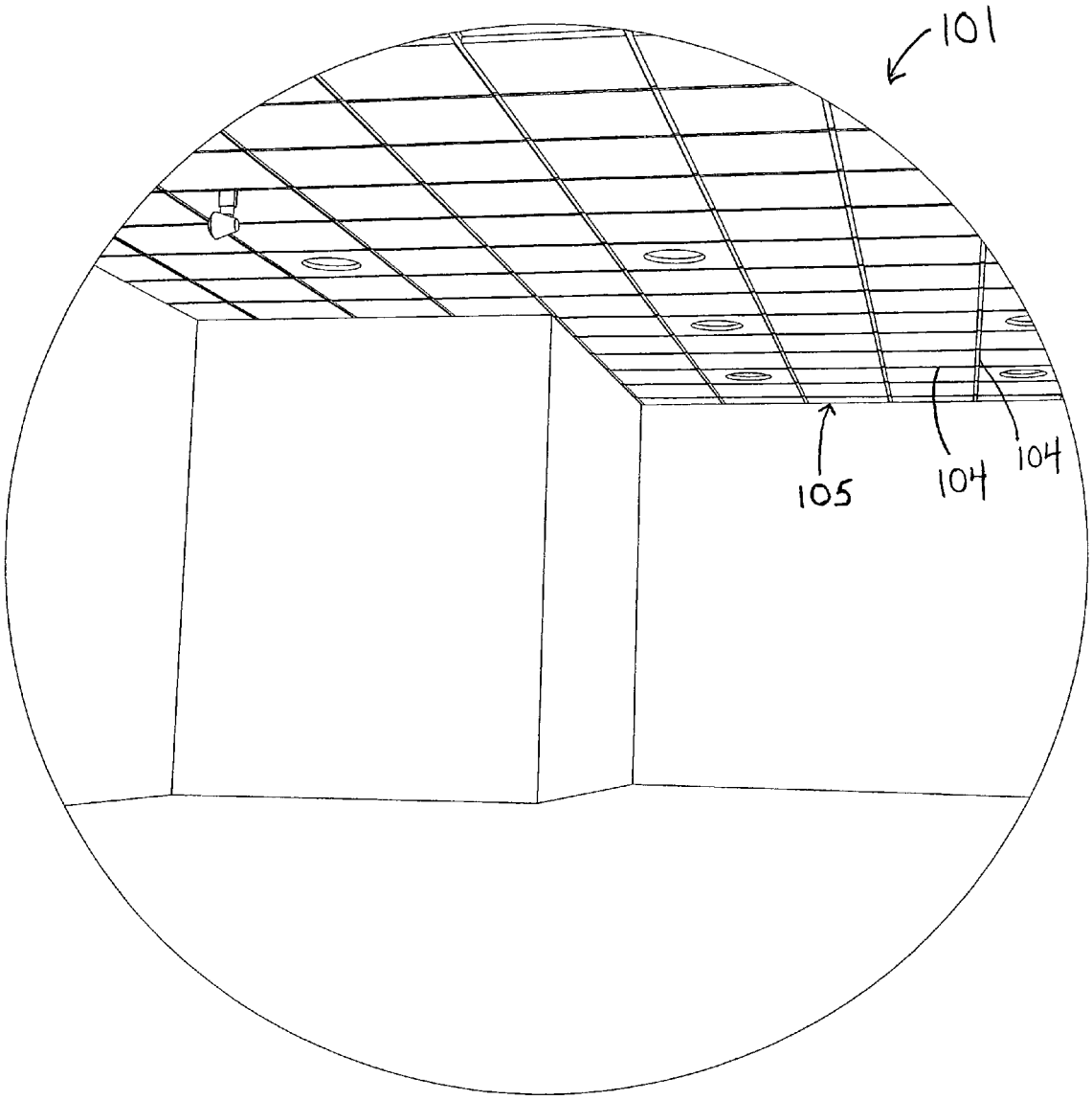
FIG. 1 shows a perspective view of a room space having an electrified ceiling according to an embodiment of the present invention.

The present invention is directed to a means to bring electricity to an internal bus bar without creating keep-out zones. For illustrative purposes, FIG. 1 shows a portion of an interior room space 101 having a ceiling system comprising a plurality of support grid members 104 forming a grid framework 105. Though the grid framework 105 is shown as part of a ceiling system, any system utilizing a grid framework, including floors and walls, can utilize the technology of the invention. These systems 105 typically include components such as decorative tiles, acoustical tiles, insulative tiles, lights, heating ventilation and air conditioning (HVAC) vents, which are positioned in the grid openings defined by the support grid members 104. An electrical bus way can be provided by interfacing a low-voltage power and/or signal source (not shown) with a pair of conductors 106 and 106' (FIG. 2) positioned internally in one or more support members 104 of the grid framework 105.

Figure 2:
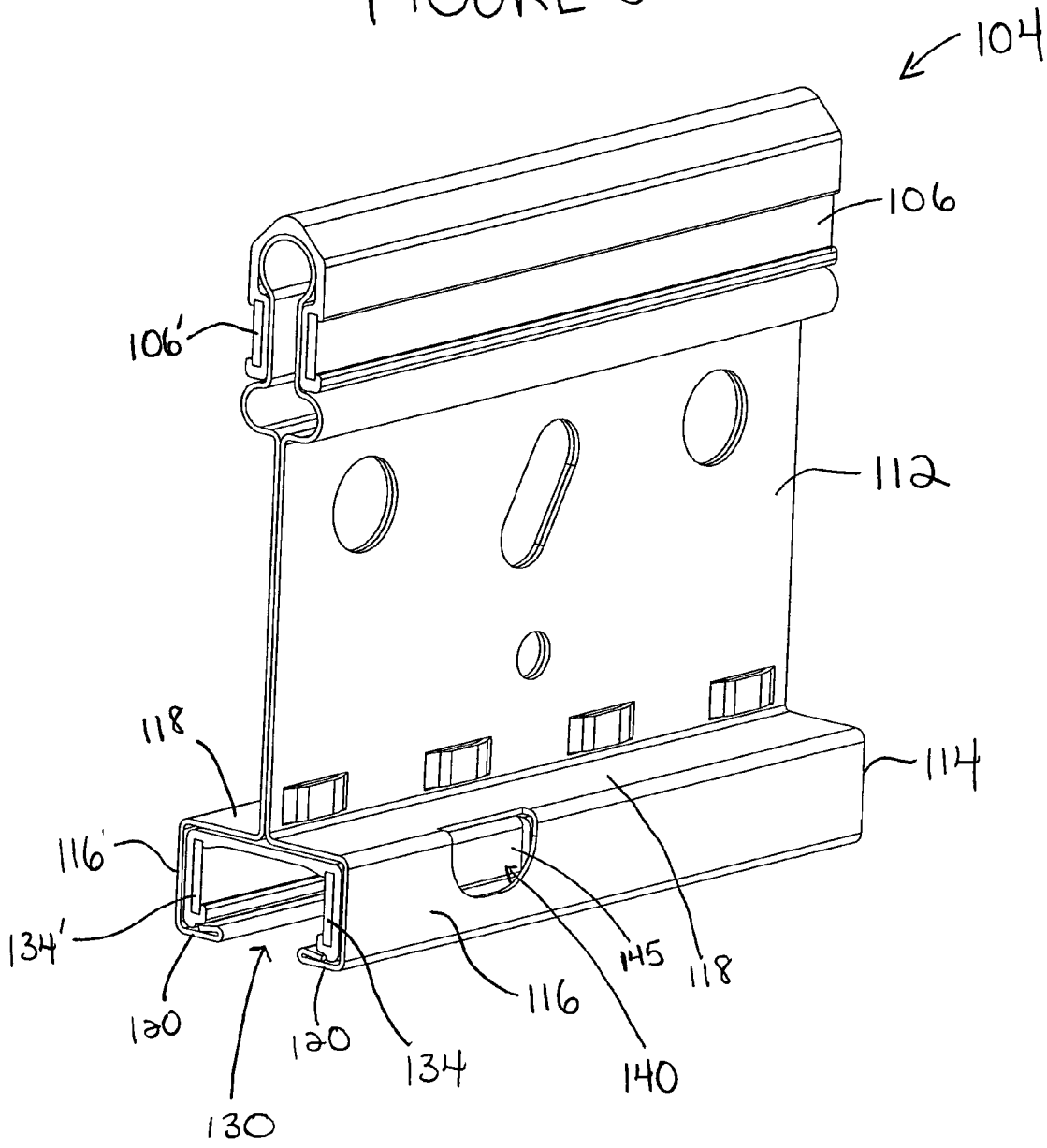
FIG. 2 shows a perspective view of a portion of an example support member of the invention.
Figure 3:
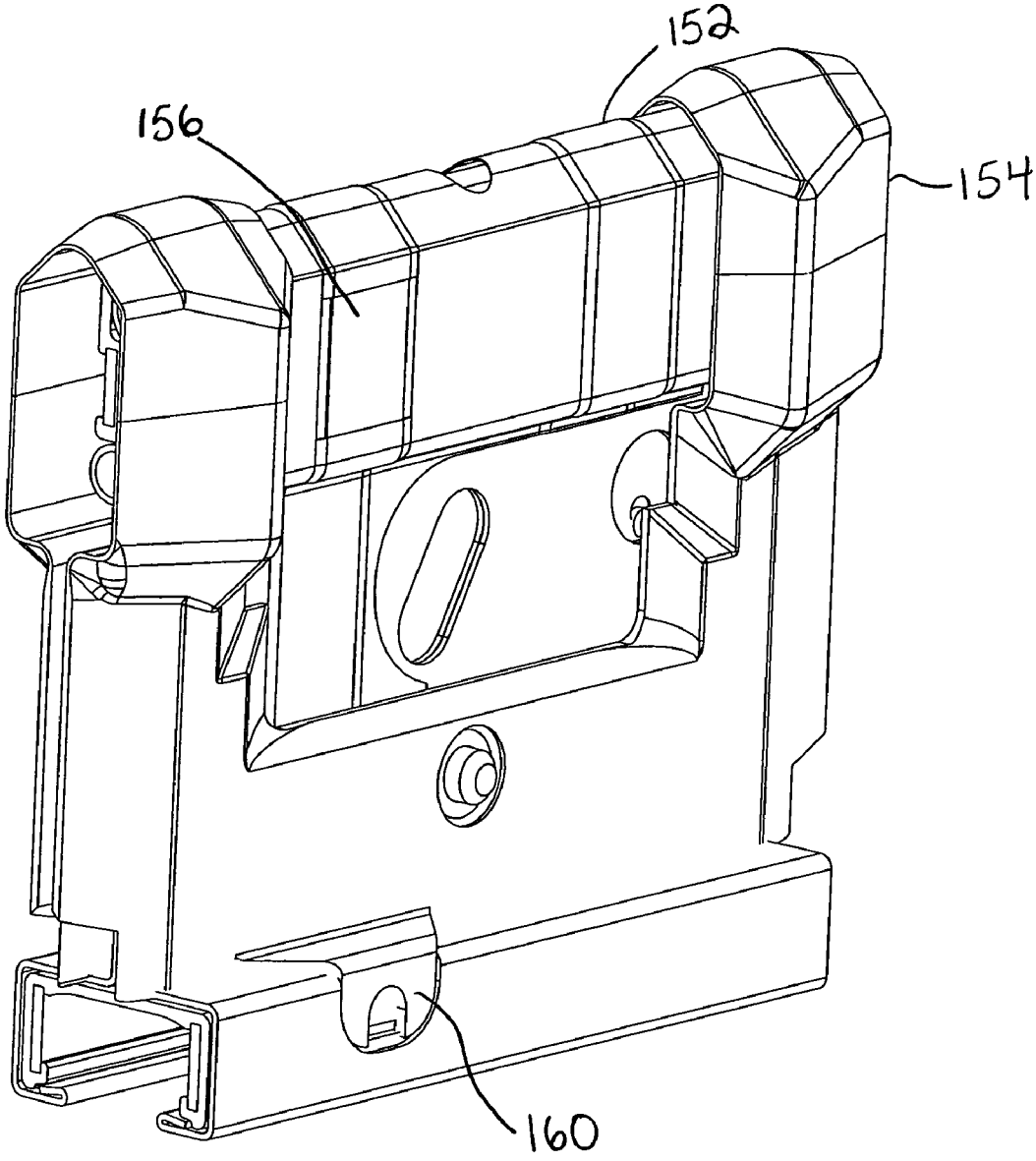
FIG. 3 shows a perspective view of the support member of FIG. 2 having an electrical interconnection means attached thereto.

A well known support grid member 104 is sold by Armstrong World Industries, Inc. under the name SILHOUETTE and is shown in FIG. 2. These SILHOUETTE support grid members 104 are commonly used in suspended ceiling systems utilizing lay-in panels and, particularly, panels having a stepped edge detail. These longitudinally extending support members 104 include an elongated vertical web portion 112 from which a support flange 114 extends. The lower support flange 114 includes opposing: side walls 116; top walls 118; and bottom walls 120 which define a hollow longitudinal passageway 122 as can best be seen in FIG. 4. A longitudinal opening 130 is formed between the bottom walls 120 which makes the hollow longitudinal passageway 122 accessible.

As further shown in FIG. 2, a pair of longitudinally extending electrifiable conductors 134, 134' can be positioned inside this lower flange portion 114, which, in turn, forms an internal bus bar. In the example embodiment shown, each conductor 134, 134' is positioned such that each conductor provides an accessible contact surface 135, 135' (see FIG. 4).

Figure 4:
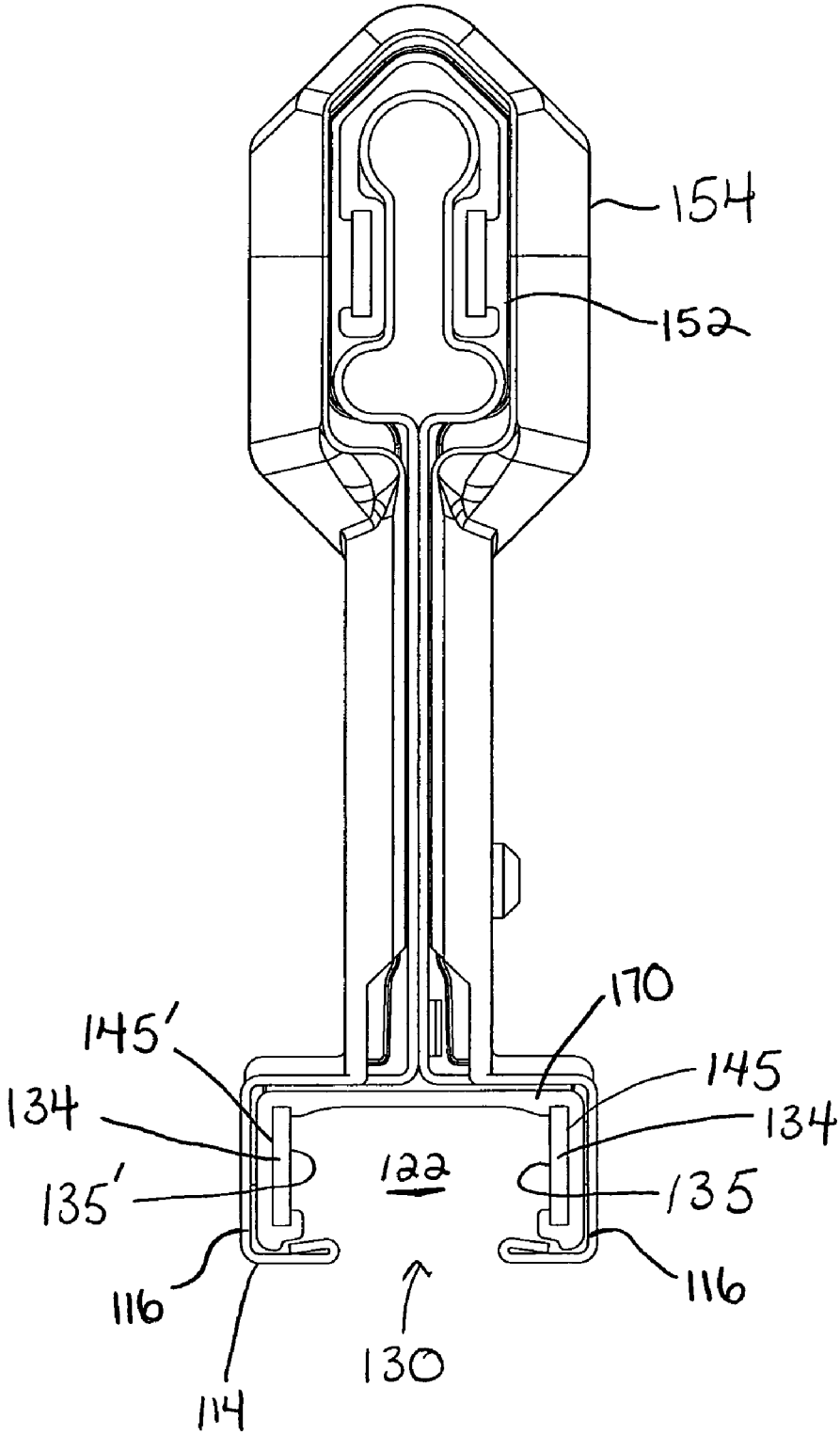
FIG. 4 shows an elevated front view of FIG. 3.
Figure 5:
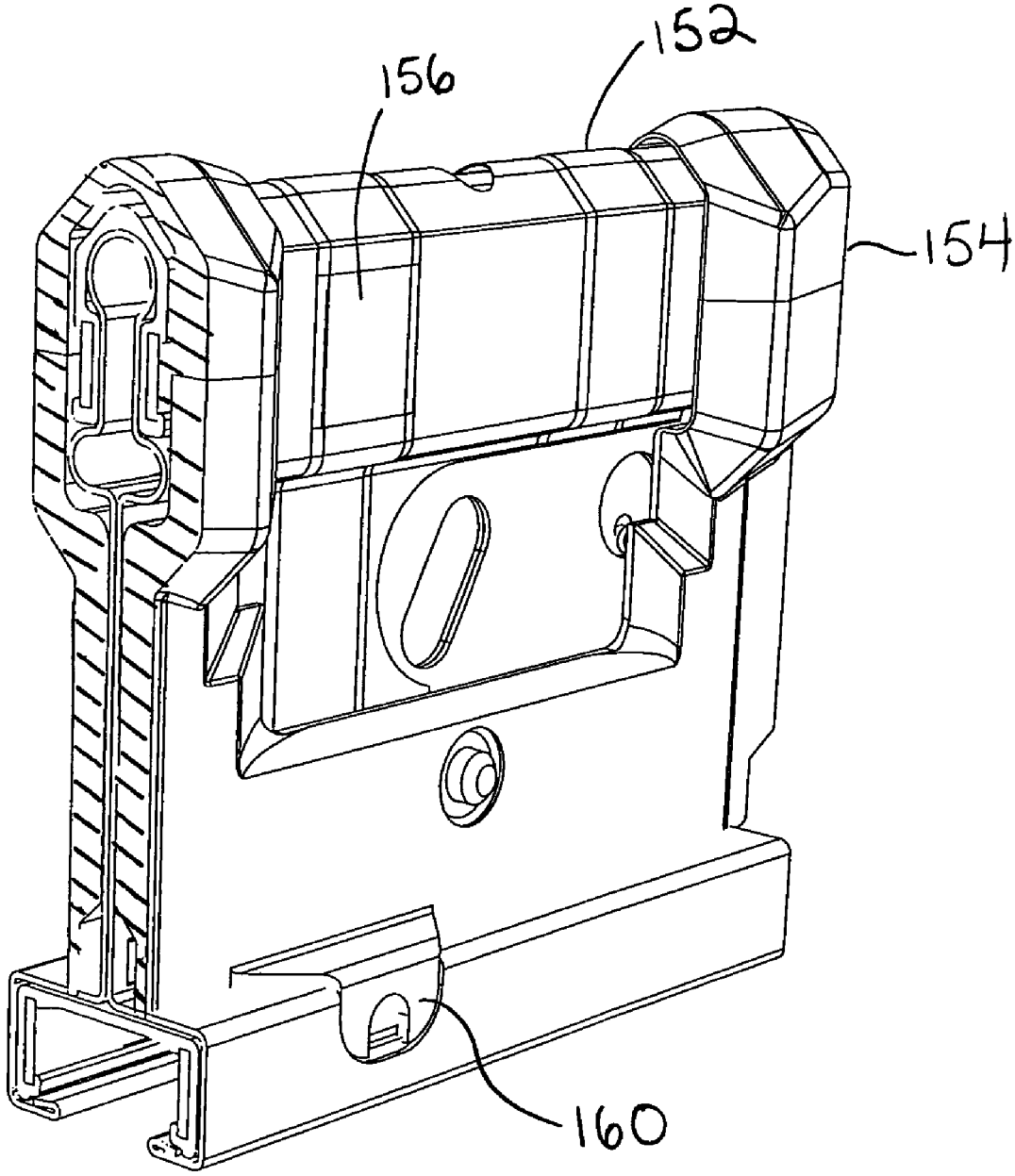
FIG. 5 shows FIG. 3 in partial cross-section.
Figure 6:
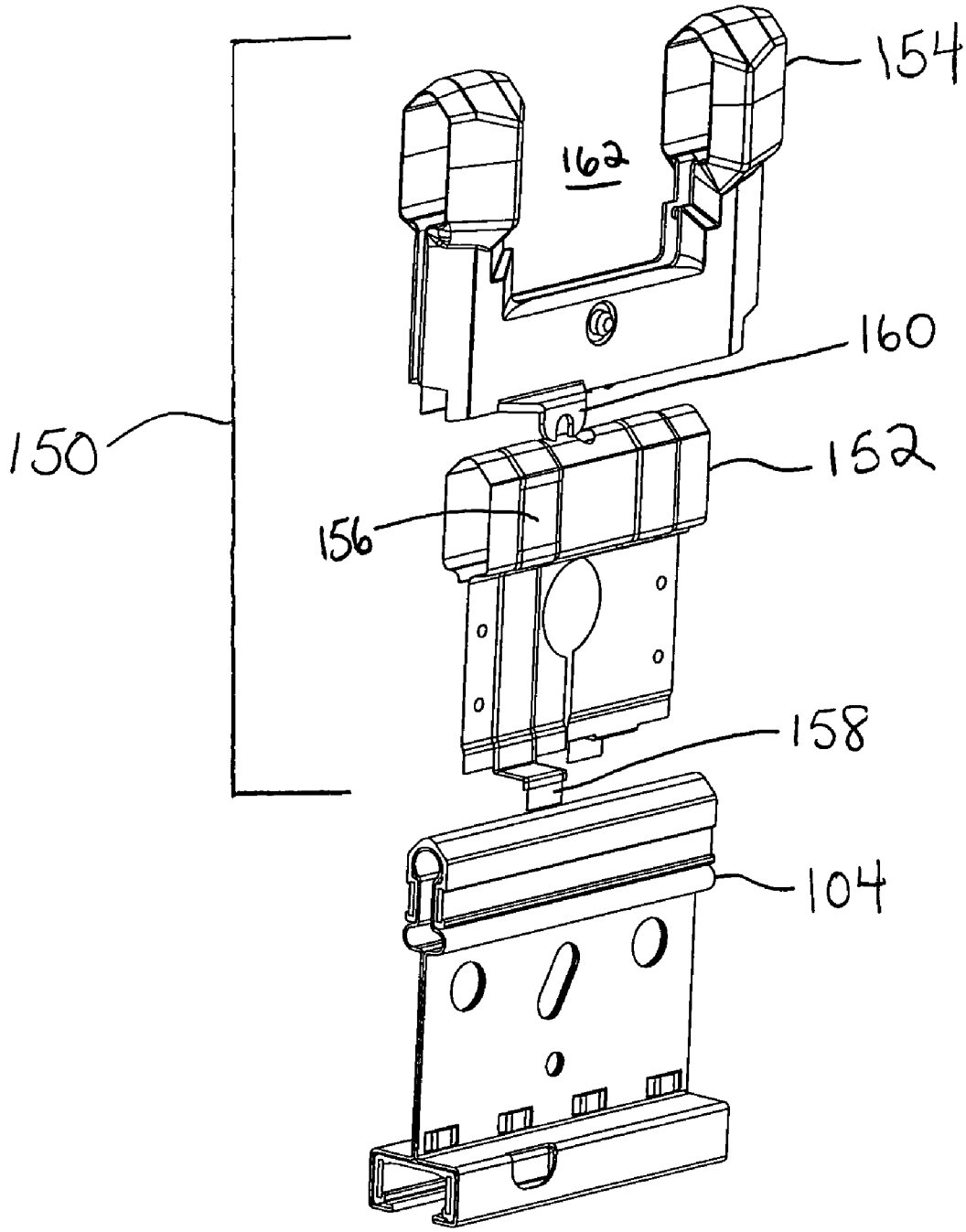
FIG. 6 is an exploded view of FIG. 3.
Figure 7:
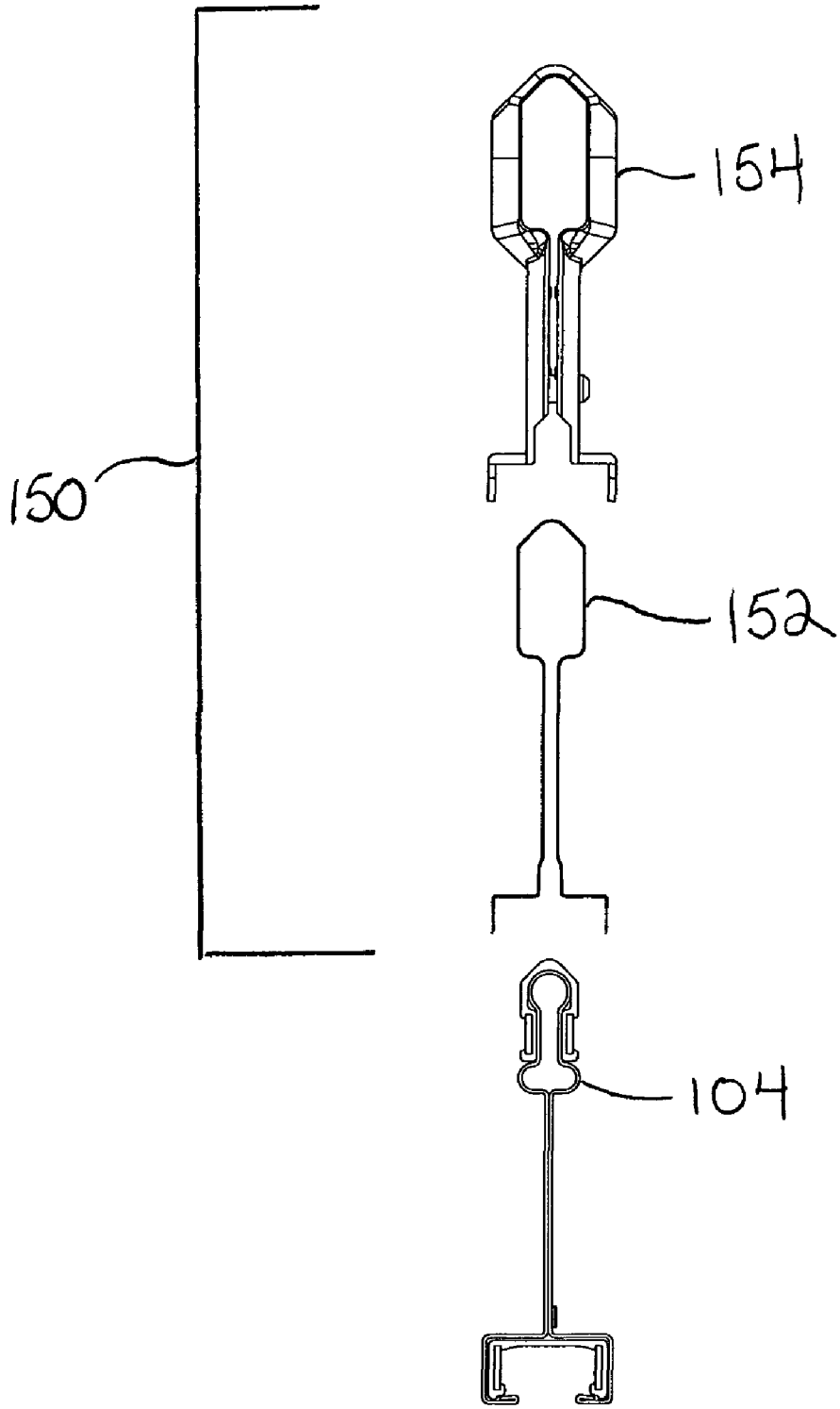
FIG. 7 is an elevated front view of FIG. 6.

As best seen in FIG. 4, each of the opposing sidewalls 116 include an aperture 140 which exposes the backside 145, 145' of the conductive wires 134, 134' which would otherwise be non-accessible. These apertures 140 will also be referred to herein as "electrical interconnection access slots". These electrical interconnection access slots provide a means in which electricity can be brought from a power and/or signal supply to the backside 145, 145' of the conductors 134, 134'; an area which does not interfere with the contact surfaces 135, 135' of the continuous electrified bus way. More specifically, the connection of the power and/or signal source to the conductors 134, 134' does not physically obstruct the contact surfaces 135, 135' of the conductors such that the entire conductive path provided via the hollow longitudinal passageway 122 is preserved for the electrical connectivity of peripheral devices, such as lights, or connectors therefore. As a result of such configuration, peripheral devices and connectors can be attached to the grid support member 104 via channel 130 at any point along the length thereof, i.e. there are no keep-out zones.

In grid framework systems 105 which contain peripheral devices and panels, the interconnection access slots 140 may be difficult to access. Thus, direct attachment of the power and/or signal source via these slots 140 may not be practical. As shown in FIGS. 3-7, an electrical interconnection means 150 can be used to bring electricity to the backside of the conductors 134, 134'.

In the example embodiment shown, the electrical interconnection means 150 (FIGS. 6 and 7) includes: planar three-dimensional circuitry 152, such as flex circuitry or an insertion molded circuit; and a flex circuitry retainer 154. For illustrative purposes, flex circuitry is shown in FIGS. 3-6. The flex circuitry includes conductive material, such as copper or aluminum which is substantially embedded in non-conductive material such as plastic. The flex circuitry 152 can be folded over, snapped onto, or otherwise affixed to the top portion of the grid support member shown in FIG. 2.

In one example embodiment, the flex circuitry 152 straddles over top of the support grid member. The flex circuitry extends down opposing sides of the vertical web portion such that a portion of the conductive material is at least partially exposed in order to make an electrical connection with a power and/or signal source. A preferred area for such power and/or signal source contact area 156 is in alignment with the top portion of the support member. Aligning the contact area with the top portion of a grid support member enables multiplexing of the power-in connector shown and described in U.S. Patent Application Publication No. 2008/0087464. As shown in U.S. Patent Application Publication No. 2008/0087464, the power-in connector attaches to the top portion, e.g. bulb of a support member, and, can be used to mate the power and/or signal source with the exposed conductive material of the flex circuitry aligned with the top portion of the support member.

In the example embodiment illustrated throughout the various views, the conductive material of the flex circuitry extends downwardly from the top portion of the grid member until a second exposed portion is in alignment with access slots 140. The second exposed portion 158 (FIG. 6) can mate via the access slot with the backside of the conductor. Resistance welding is an example of a way to mate these conductive surfaces.

The flex circuitry 152 may be protected and held into position by a retainer 154. As shown, a "U-shaped" retainer 154 straddles over top of the flex circuitry and, in turn, the support grid member. The retainer 154 extends down both sides of the vertical web portion 112. The flex circuitry can be folded over or snapped onto the top of the flex circuitry and grid assembly. The retainer is preferably made of non-conductive material such as molded plastic. The retainer may include a tab 160 which can act as a protective covering for the electrical connection between the flex circuit and the back side of the conductor. It should be noted that the retainer eliminates the need for using an adhesive to attach the flex circuitry to the grid member. It should also be noted that the retainer also provides a cavity 162 (FIG. 6) for ease in field placement and proper positioning of a power-in connector, such as those described in U.S. Patent Application Publication No. 2008/0087464. This retainer cavity properly positions the power-in connector, in relation to the flexible circuitry which would otherwise be a blind mate.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

For example, as shown throughout the drawings, an insulating element 170 may be used to insulate the conductor from the support member. As can best be seen in FIG. 4., the insulating element 170 generally conforms to the shape of the hollow longitudinal passageway 122 and interposes the conductors 134, 134' and a respective side wall 116 of the lower flange 114 of the support member. As shown, the insulating element 170 must include a corresponding aperture which is in overlapping relation to access slot 140 so that the backside 145, 145' of the respective conductor is exposed.

We claim:

1. An electrified framework system for bringing power and/or signal to electrically powered devices, the system comprising:

at least one longitudinally extending electrified bus bar, the bus bar having a housing which includes a pair of conductors positioned therein, the conductors each having a mating surface which provides a continuous conductive path for electrical connection of devices; and an electrical interconnection means which brings electricity to the conductors without interfering with the mating surface of the conductors, the electrical interconnection means thereby providing no unavailable point along the continuous conductive path for electrical connection of devices.

2. The system of claim 1, wherein the bus bar includes a longitudinally extending vertical web portion and a lower flange portion extending from an edge of the vertical web portion.

3. The system of claim 1, wherein the electrical interconnection means comprises flex circuitry.

4. The system of claim 3, wherein the electrical interconnection means comprises a flex circuitry retainer which holds the flex circuitry in position on the bus bar.

* * * * *